US006905116B2

(12) United States Patent
Cummines et al.

(10) Patent No.: US 6,905,116 B2
(45) Date of Patent: Jun. 14, 2005

(54) TOGGLE CLAMP WITH COMPRESSION SPINDLE ASSEMBLY FOR CLAMPING

(75) Inventors: Rich Cummines, Fenton, MO (US); William Casseau, St. Louis, MO (US)

(73) Assignee: Carr Lane Manufacturing Co., St. Louis, MO (US)

( * ) Notice: Subject to any disclaimer, the term of this patent is extended or adjusted under 35 U.S.C. 154(b) by 0 days.

(21) Appl. No.: 10/919,422

(22) Filed: Aug. 16, 2004

(65) Prior Publication Data

US 2005/0017418 A1 Jan. 27, 2005

Related U.S. Application Data

(62) Division of application No. 10/133,034, filed on Apr. 26, 2002, now abandoned.

(51) Int. Cl.[7] ..... B25B 1/19
(52) U.S. Cl. ..... 269/228; 269/224
(58) Field of Search ..... 269/228, 216, 269/249, 254 CS, 229, 254 R; 267/286, 291, 69–71, 130, 136, 137, 166, 177, 178, 221; 188/195, 205 R, 265; 248/560, 579, 675, 574, 578, 622, 623; 242/598, 598.5, 598.6, 599.1

(56) References Cited

U.S. PATENT DOCUMENTS

| | | | | |
|---|---|---|---|---|
| 2,327,368 A | | 8/1943 | Olson | |
| 2,501,238 A | * | 3/1950 | Sarsgard et al. | 81/351 |
| 2,502,804 A | * | 4/1950 | Spencer | 81/351 |
| 3,212,347 A | | 10/1965 | Robeson | |
| 3,391,635 A | | 7/1968 | Matheus | |
| 3,602,537 A | | 8/1971 | Kerstholt et al. | |
| 3,799,533 A | * | 3/1974 | Malott | 269/32 |
| 3,872,760 A | | 3/1975 | Desnoyers, Jr. | |
| 4,108,589 A | | 8/1978 | Bunch | |
| 4,274,768 A | | 6/1981 | Kato | |
| 4,335,873 A | | 6/1982 | Kiefer | |
| 4,407,493 A | | 10/1983 | Okolischan | |
| 4,821,393 A | * | 4/1989 | Spigarelli | 29/283 |
| 4,877,226 A | | 10/1989 | Taylor | |
| 5,186,439 A | | 2/1993 | McDonagh et al. | |
| 5,275,391 A | | 1/1994 | Lynn et al. | |
| 5,435,533 A | | 7/1995 | Weinmann, Jr. | |
| 5,527,024 A | | 6/1996 | Dysktra | |
| 5,685,527 A | | 11/1997 | Harbali et al. | |
| 5,688,014 A | | 11/1997 | Kot | |
| 5,758,919 A | | 6/1998 | Matheis | |
| 5,921,535 A | | 7/1999 | Lutz, III | |
| 5,924,685 A | | 7/1999 | Webb | |
| 6,315,278 B1 | * | 11/2001 | Gaztanaga | 269/228 |

FOREIGN PATENT DOCUMENTS

| | | |
|---|---|---|
| CH | 625588 A5 | 9/1981 |
| DE | 3416996 A1 | 11/1985 |
| DE | 3608094 A1 | 9/1987 |

* cited by examiner

*Primary Examiner*—Robert C. Watson
(74) *Attorney, Agent, or Firm*—Thompson Coburn LLP

(57) ABSTRACT

A toggle clamp comprises a compression spindle assembly with a plunger and a spindle. The plunger has a chamber dimensioned to slidingly receive the spindle in a telescoping arrangement, and a resilient member disposed in the plunger chamber to urge the spindle away from the plunger chamber. A screw extends through a bore of the spindle and the plunger chamber and is threaded into the plunger to bias the resilient member and maintain the spindle in sliding contact with the plunger chamber. The screw has a head abutting a shoulder monolithically formed in the spindle bore. The screw is rotatable to adjust a level of compression of the resilient member. The compression spindle assembly reliably applies a gradual rate of pressure as the compression spindle assembly is compressed.

15 Claims, 4 Drawing Sheets

TOGGLE CLAMP WITH COMPRESSION SPINDLE ASSEMBLY FOR CLAMPING

RELATED APPLICATION DATA

This application is a divisional application of application Ser. No. 10/133,034, filed Apr. 26, 2002, now abandoned.

BACKGROUND OF THE INVENTION

1. Field of the Invention

This invention relates generally to clamps for positioning and holding work pieces during manufacturing and, more particularly, to clamps capable of automatically adjusting for holding work pieces of varying thicknesses.

2. Related Art

Manufacturing operations typically require that a work piece be held in place during machining, assembly and similar operations. Work pieces are held by presses, dies and, most commonly, by clamps. Many of these manufacturing operations are still hand operated. Thus, repetitive clamping of multiple work pieces for repetitive machining or assembly procedures creates predictable needs for efficiency, speed and ease of use.

This creates a need for automatic adjustment of a holding device, such as a clamp, to accommodate work pieces of various thicknesses and to thereby avoid the otherwise required re-positioning by hand of a clamp or the like. Work pieces of varying thicknesses necessarily result simply due to manufacturing tolerances. There is a particular need for minimizing or eliminating repetitive adjustments of clamping members when alternating between work pieces intended to be of various thicknesses.

Prior art clamps which will securely clamp work pieces having a minimally varying thickness include U.S. Pat. No. 3,212,347 to Robeson. This patent discloses a clamp having a spring to mediate the pressure applied by a plunger to a work piece. However, the plunger in that clamp may not be mounted in other clamps. Moreover, the compression of the spring cannot be readily adjusted and instead is fixed at the time of manufacture.

Worker safety is and virtually always has been a serious concern. Work piece holding devices are generally safer to the extent that they can eliminate pinch points where a worker may pinch his hand, especially in those applications where re-positioning of the work pieces into and out of the device may be done repetitively and at speed. Prior art clamps, to the extent that they use springs to compress a plunger and bias it towards a work piece generally do not enclose the spring, and thereby expose workers to pinch points. Another aspect of worker safety involves equipment design that reduces the risk of repetitive motion injury by reducing the necessary amount of force a worker must exert to engage a clamp. The prior art devices not providing some adjustability in spring force, or otherwise not allowing for some mechanical advantage place the worker at risk for this kind of injury as well.

There is thus a need in the art for a clamp to apply various degrees of pressure to accommodate work pieces made of various materials in order to prevent damage to the work pieces from excessive pressure. There is also a need to avoid movement of the work piece from its desired position by the type of sudden application of force often produced by toggle clamps or locking clamps. A holding apparatus, such as a clamp, that gradually exerts pressure on a work piece with a "soft start," is needed. There is also a need for a clamp that will have a totally encapsulated spring, thus avoiding pinch points, but which can provide a soft clamping and accommodate variously sized work pieces. Still further there is a need for a clamp that is easily assembled, and which can be adjusted to provide a different clamping pressure.

SUMMARY OF THE INVENTION

It is in view of the above needs that the present invention was developed. The invention generally comprises a compression spindle apparatus adaptable for use with manufacturing holding apparatuses, especially clamps.

A preferred embodiment of the compression spindle apparatus includes a plunger having an abutment surface at one end for contacting and applying pressure to the work piece. The plunger has an axial bore open at the end of the plunger opposite the abutment surface for receiving a helical compression spring and a spindle. The bore has a first portion wide enough to receive the spring, and the bore transitions to a smaller diameter with a shoulder being formed thereat and against which the spring rests. A threaded screw attaches the spring inside the plunger by extending through the center of the spring and screwing into the smaller diameter of the plunger bore.

A spindle encloses the other end and is inserted into the bore over the spring, with the head of the screw engaging a shoulder of the spindle. The spindle is dimensioned to be inserted in close contact with the inside of the bore so that there is no gap or opening through which the spring may be exposed to create a pinch point. The spindle also has an axial bore, with a change in diameter creating the aforementioned annular shoulder much like the plunger bore. Unlike the plunger bore however, the spindle bore is a through hole. Thus, the screw may be inserted entirely through the spindle bore until the head of the screw seats on the annular shoulder of the spindle bore. The screw is then threaded into the plunger bore threads to thereby create the plunger/spring/spindle assembly.

The plunger/spring/spindle assembly allows the plunger and spindle to move relative to each other while compressing the spring, when the plunger abuts a work piece to hold it. At a rest position the screw head engaging the spindle annular shoulder limits the extension of the plunger and spindle. Thus, the plunger/spring/spindle assembly provides a telescoping assembly that is self contained and modular. This plunger/spring/spindle assembly of the present invention may thus be mounted in a variety of clamps, dies and presses. This adaptability is not found in prior art devices.

The telescoping action of the compression spring assembly allows it to be used on work pieces of varying thicknesses without adjustment between uses.

As noted, in the preferred embodiment, the spring is entirely encapsulated by the plunger and the spindle. Thus the spring is not exposed and no pinch points are created to cause worker injury.

The screw also serves to allow for adjustment of the spring compression, and thereby the pressure exerted by the plunger. The screw can be tightened to compress the spring and loosened to release pressure on the spring, to thereby provide for an adjustable pre-load. Of course, various kinds of springs may also be used, each of which could exhibit different compression characteristics. The ability to adjust the spring compression characteristics and pre-load a desired pressure is a good and valuable feature.

In a preferred embodiment the end of the spindle not engaged with the plunger bore has a through hole perpendicular to its longitudinal axis. A lever pin may be inserted through this hole to mount the assembly in a clamp or other holding device.

In operation, the plunger/spring/spindle assembly, or simply the compression spindle assembly, is preferably mounted on a clamp or other holding device to allow movement in an axial direction, but to limit movement in other directions. The spindle preferably has an actuation means, such as a toggle clamp lever, attached to it via the pin extending through the perpendicular through hole. To clamp a work piece, pressure is applied to the spindle via a lever pin or other force application mechanism. The compression spring assembly moves as a unit towards the work piece. Upon the plunger contacting the work piece, the spindle moves along the plunger axis, through the plunger bore in a telescoping action towards the work piece. The movement of the spindle towards the work piece compresses the spring until the full travel position of the lever or other holding mechanism is reached. The amount of pressure created by the spring is that degree of pressure preselected by a worker's adjustment of the screw. The spring compression allows the assembly to accommodate differences in work piece size or positioning without re-adjustment. Further, the spring mediates the application of pressure to the work piece.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
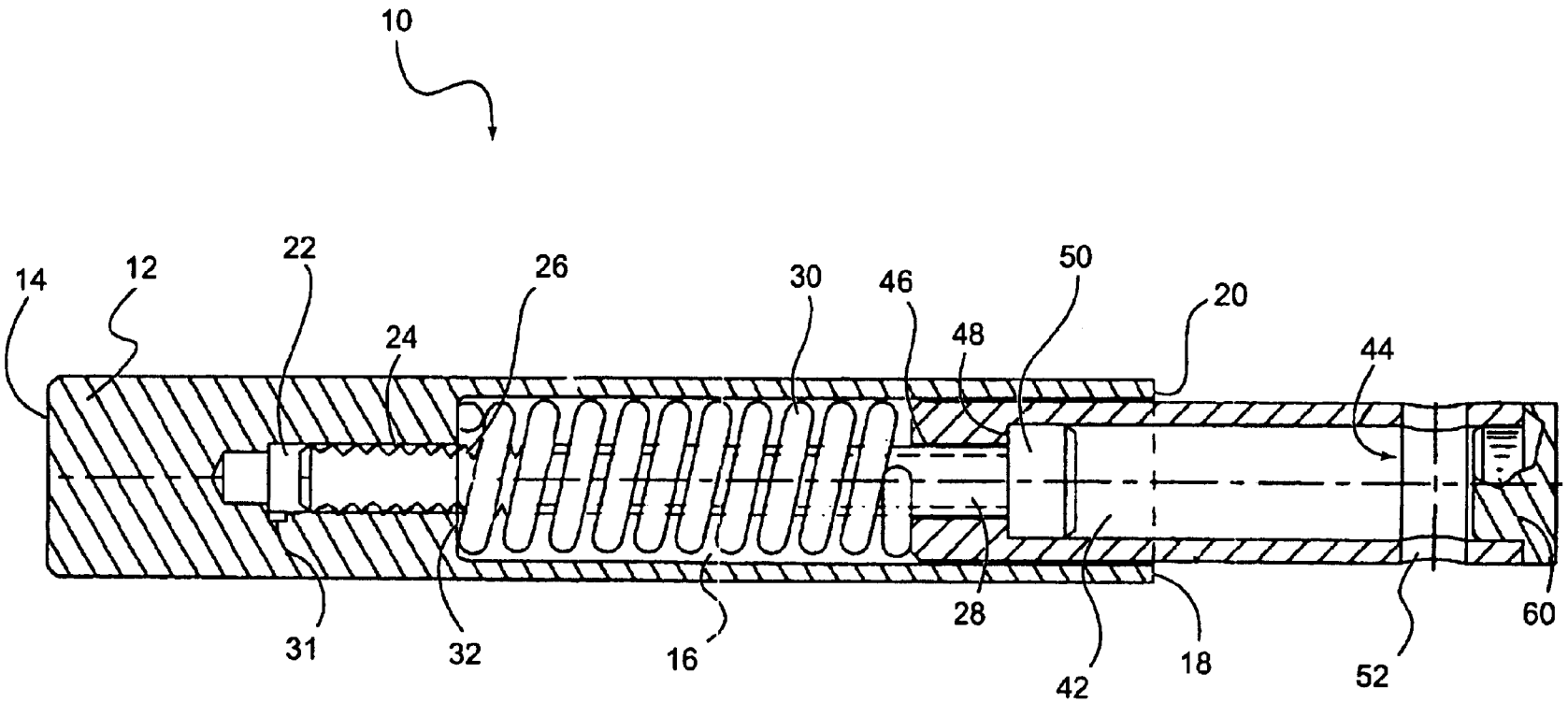
FIG. 1 is a cutaway side view of the compression spindle apparatus.

Referring now to FIG. 1, wherein like reference numbers identify like parts, the compression spindle assembly 10 of the present invention has a plunger 12 with an abutment surface end 14 for holding a work piece (not shown). A bore 16 is formed at the end 18 of the plunger opposite the abutment surface end 14. The bore 16 has a spring mount portion 20 with a larger diameter and a screw mount portion 22 with a smaller diameter. The screw mount portion 22 is closer to the plunger abutment surface end 14. Plunger 12 and bore 16 are preferably coaxial. The step transition between the spring mount portion 20 and the screw mount 22 forms an annular shoulder 32. Spring 30 is disposed in spring mount portion 20 and one end thereof rests against shoulder 32. Spindle 40 is preferably sized to closely fit within the inner diameter of spring mount portion 20 and has a through hole 42 with an opening 44 at one end and a screw inlet 46 at its opposite end. In the depicted embodiment, opening 44 has an optional cap 60. Spindle 40 also preferably has a perpendicular through hole 52 for receiving a drive pin for linking the compression spindle assembly of the present invention to a clamp lever.

Screw inlet 46 preferably has a smaller diameter than through hole 42 so that a step transition formed at their juncture creates a screw cap seat 48. A threaded screw 28 has a cap 50 at one end and threads 26 along its shank and preferably near its outboard end. Screw mount portion 22 preferably has threads 24 formed to receive and fixedly secure corresponding threads 26 to thereby retain screw 28 within bore 16. Screw 28 has sufficient threads 26, and screw mount portion 22 is sufficiently long, to allow screw 28 to be reliably retained and secured within bore 16 without driving screw 28 fully into screw mount portion 22, as shown in FIG. 1. This allows the spring loading to be adjusted, both with respect to the spring parameters and the pre-load or initial compression set as the compression spindle assembly 10 is first made or later adjusted. In FIG. 1, gap 31 indicates the space into which the screw 28 may be turned in order to further compress the spring 30.

In assembly, spring 30 is inserted into spring mount portion 20 of plunger 12. Spindle 40 is then inserted into spring mount portion 20, contacting the top of spring 30 and encapsulating it. Preferably, the longitudinal opening through spring 30 substantially aligns with through hole 42 and screw inlet 46 such that screw readily slides into place. Screw 28 may then be inserted first through the wide opening 44, through hole 42, and then through the narrow screw inlet 46 of spindle 40. Screw 28 is further inserted through spring 30 arid threaded into the screw mount portion 22 of bore 16. Screw 28 is preferably turned at least until screw cap 50 seats against screw cap seat 48 in spindle 40. Screw 28 then retains the spindle 40 in the bore 16 of plunger 12, and contains both ends of spring 30. Screw 28 can thereafter be further turned to adjust and to set a predetermined compression of spring 30.

In operation, spindle 40 is driven towards a work piece in a manner described below. When the abutment surface 14 contacts the work piece, telescoping of the spindle 40 within plunger 12 compresses spring 30 until the mechanical driver reaches its locked position. At that position, the work piece is reliably held in position under pressure of the compressed spring 30. Preferably, the compression spindle assembly is adjusted, by choosing the spring and screw position with respect to the spring, so that the desired amount of spring compression is achieved for the work piece being held by the clamp within which the compression spindle assembly is used. As the plunger is spring loaded, the work piece is not shifted or damaged by being engaged with a "hard" mechanical linkage type clamp, and instead is locked in place under spring pressure.

With the present invention, the worker need not continuously adjust the stroke of the clamp, or other mechanical structure of the clamp, thereby minimizing the amount of hand movement needed to process successive work pieces and diminishing the risk of repetitive motion injuries. Furthermore, the spring is completely encapsulated, hidden from view and shielded from workers fingers and clothes, thus eliminating pinch points and the reducing risk of injury.

It will be readily apparent to those of skill in the art that various design alternatives are available without departing from the scope of the present invention. For example, the helical compression spring 30 may be replaced with a grommet of rubber or other resilient material. It may also be replaced with a spring washer or a series of spring washers. Still any other type of resilient type of material may be used which provides for relative movement between the plunger and spindle and which applies a force under compression.

The plunger, bore and spindle may be rectangular or other shapes in cross section besides the preferred cylindrical shape. The plunger may comprise the male portion and the spindle the female member, so that telescoping movement between the two is reversed.

Likewise, the spindle and spring may be retained by means other than screw 28. These means may include a center post extending through the spring with a nut for fastening at the end of the center post, a center post with a rivet, or a screw extension machined into the spindle. An annular ring may be used between the bore 16 of plunger 12 and the exterior surface of the spindle 40, with seating of the annular ring in a step or detent in the interior surface of bore 16 or the exterior surface of spindle 40. Design alternatives also include inserting and retaining an adjustment screw 28 from the opposite direction, i.e., by boring through the center of the abutment surface 14 of plunger 12. A screw would then be inserted through that bore, and through the helical compression spring to engage the threads of a female mount in spindle 40. The screw cap would then seat in a recess in the abutment surface 14. Even further design alternatives are possible by using press fittings assembled by force and without threads.

Figure 2:
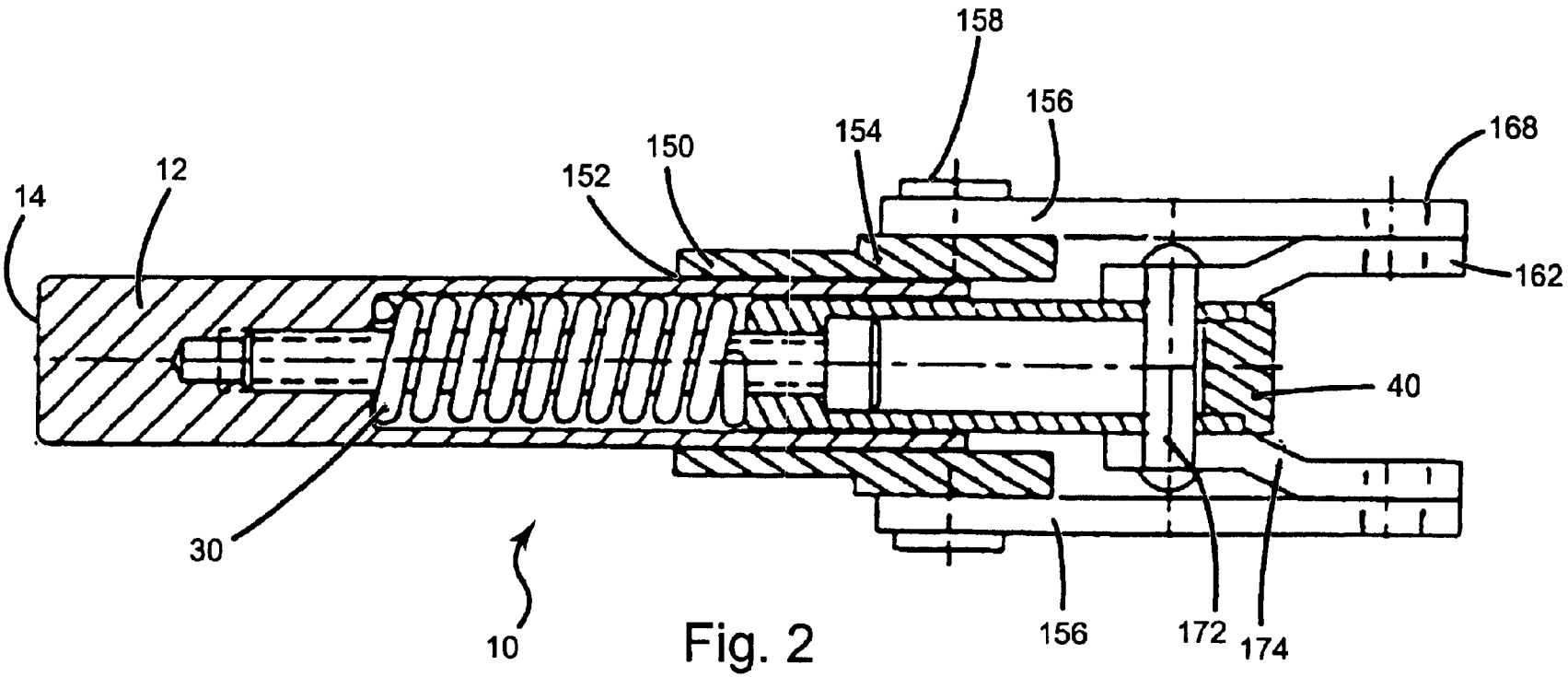
FIG. 2 is a cutaway top view of the compression spindle apparatus as installed with a typical toggle clamp.
Figure 3:
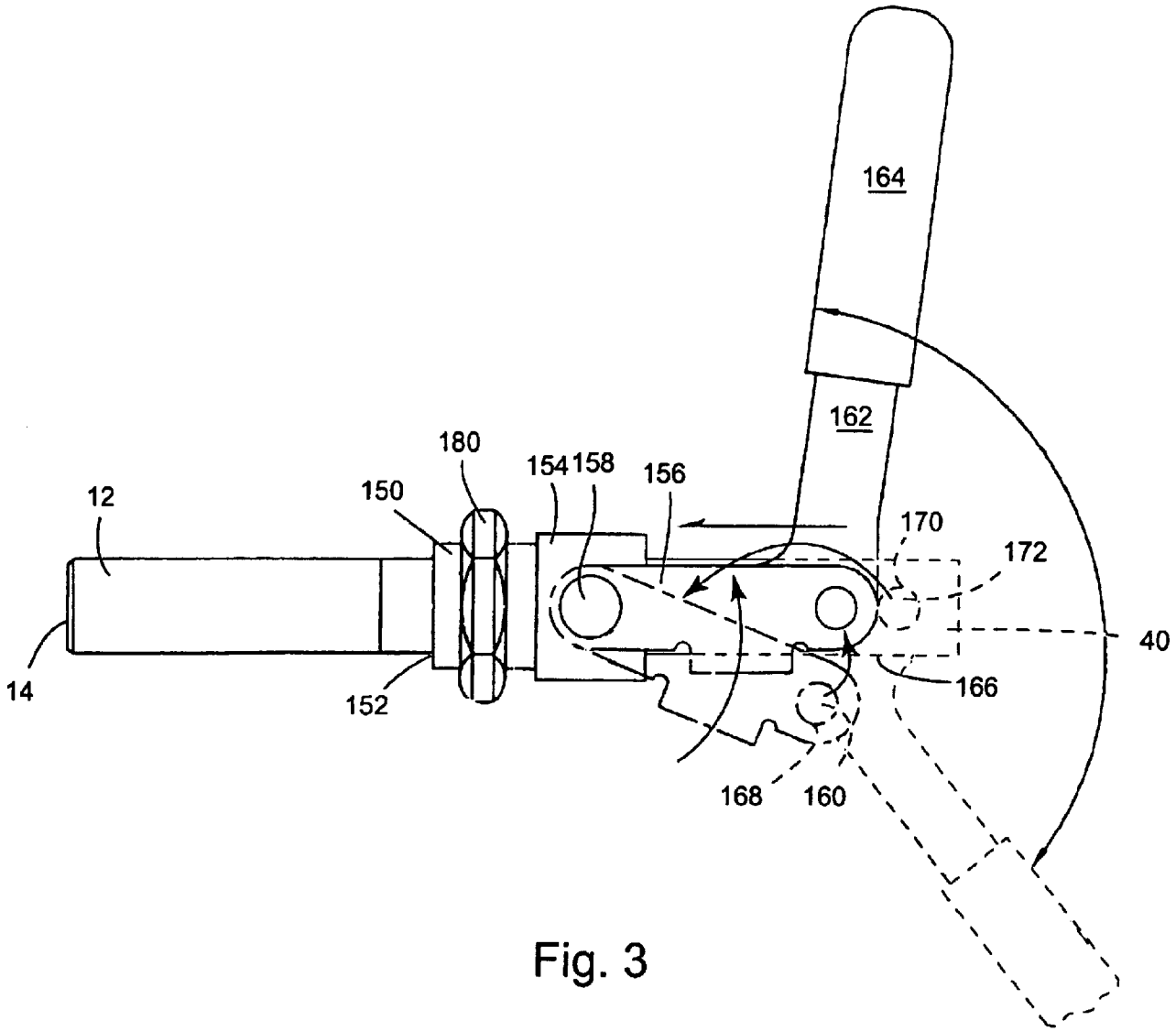
FIG. 3 is a side view of the compression spindle apparatus as installed with a typical toggle clamp.

FIGS. 2 and 3 depict the compression spindle apparatus as installed with a typical toggle or over center clamp. Plunger 12 is oriented in the clamp assembly with abutment surface 14 oriented towards a work station for holding a work piece therein. Plunger 12 must preferably be free to move axially towards a work piece and thereafter away from it. However, it must preferably simultaneously be restrained from uncontrolled movement in any other direction. Accordingly, in the depicted structure, housing 150 includes a channel 152 to receive the compression spindle assembly. Of course, housing 150 may be designed in any of a variety of configurations, with channel 152 open or fully circumscribing the compression spindle assembly. In the depicted embodiment, housing 150 is cylindrical, closes entirely around the compression spindle assembly, and further has a step to a wider portion 154 which serves as a mount for brackets 156.

FIG. 3 depicts the clamp components in their closed position with solid lines and, alternatively, in their open position with broken lines. Nut 180 is a lock nut for mounting the clamp on a block, on a wall or for otherwise mounting the clamp on a work platform. Bilateral brackets 156 are attached to housing 150 by pivot posts 158 so that the brackets 156 may rotate around posts 158. The other ends of brackets 156, oriented to the right in FIGS. 2 and 3, also have through holes 168 for receiving lever pins 160, thus providing a linkage between the lever 162 and the compression spindle assembly 10.

The lever 162 has a handle end 164 and an L-shaped foot 166. The foot 166 has two through holes; one at its heel 168 and one at its toe 170. One through hole, 168, receives lever pins 160 so that lever 162 may rotate around the axis of through hole 168. Second through hole 170, at the toe of foot 166, receives spindle pin 172 so that lever 162 may also rotatively engage the spindle pin 172 for driving the spindle 40.

The foot 166 of lever 162 has an offset 174 dimensioned to allow brackets 156 to override the outside dimension of spindle pin 172, so that spindle pin 172 may travel between the inside dimensions of brackets 156.

In operation, a work station adjacent to the toggle clamp depicted in FIGS. 2 and 3 is empty, lever 162 and handle 164 are down, in the position indicated by the broken lines in FIG. 3, and both spindle 40 and plunger 12 are retracted away from the work station, shown towards the left of FIGS. 2 and 3. Upon insertion of a work piece into the work station, an operator manually swings handle 164 upwards towards the position indicated by the solid lines in FIG. 3. Lever foot 166 simultaneously pivots around lever pin 160 and spindle pin 172. Lateral translation of the lever heel at pin 160 is restrained by solid brackets 156. Accordingly, the upward, arcuate motion of lever 162 drives spindle 40 to translate towards the work station while the toe of the lever foot 166 rotates around spindle pin 172 simultaneously. This translation continues until the lever 162 is in its fully upright position. Optionally, any of a variety of known locking mechanisms, such as an abutment, a hook, a boss and detent arrangement or a spring (not shown) may arrest and hold lever 162 in its fully upright position.

The translation of spindle 40, driven by lever 162 through spindle pin 172, is in a direction towards the work piece. When the abutment surface 14 first contacts the work piece, it applies a small amount of pressure to the work piece. As the spindle 40 continues to travel towards the work piece, it further compresses the spring 30. The compression of spring 30 increases the force urging plunger 12 against the work piece and gradually continues to increase that pressure until the lever 162 is in its fully upright position. Thereafter, the spring maintains the preconfigured degree of pressure holding the plunger against the work piece, thus securing the work piece for machining, assembly or other manufacturing operations.

Figure 4:
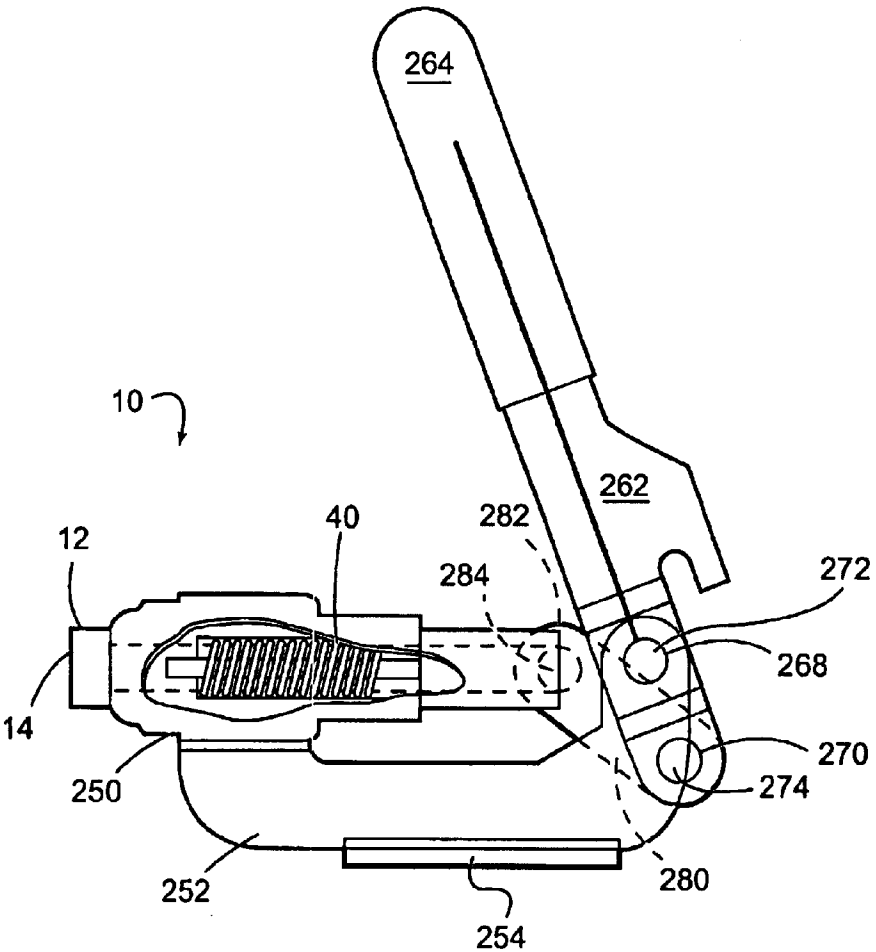
FIG. 4 is a partially cutaway side view of the compression spindle apparatus as installed with an alternative type of clamp.

FIG. 4 depicts the compression spindle assembly disposed in a clamp with a different configuration. Plunger 12 is still oriented horizontally with the abutment surface 14 facing towards a work station. Spindle 40 still faces away from the work station where it is to be engaged with a clamp. Plunger 12 is again slidingly disposed within a housing 250. Housing 250 is either a part of, or attached to a mounting base 252, which includes a mounting plate 254 for attaching the entire clamp assembly to a bench or other work platform. A lever 262 again has a handle end 264 and two through holes 268 and 270.

In the embodiment depicted in FIG. 4, both through holes 268 and 270 are in line with the longitudinal axis of the lever 262. Through hole 268 receives a pin 272 which holds lever 262 in pivoting attachment with mounting base 252. Lever through hole 270 receives a pin 274 pivotally linking lever 262 with bracket 280. Bracket 280 has two through holes at either end. One of the through holes also receives insertion of pin 274. The through hole 282 at the other end of bracket 280 receives insertion of pin 284, which is also inserted within through hole 52 of spindle 40. Pin 284 puts bracket 280 in pivoting engagement with spindle 40, providing a linkage between the lever 262 and the compression spindle assembly 10.

In operation, a worker pulls lever 262 away from the work station. The lever pivots around its mount at pin 272. Through hole 270 of lever 262 is thereby moved through an arcuate path towards the work station. Through pivoting communication with the lever by pin 274 and pivoting communication with spindle 40 through pin 284, bracket 280 transfers the arcuate motion of lever 262 into driving translation of spindle 40 towards the work piece. Thereafter, in the manner previously described, spindle 40 drives abutment surface 14 into holding contact with a work piece in a gradual manner mediated by spring 30 of the compression spindle assembly.

Those of skill in the art will recognize the variety of linkage assemblies with which the compression spindle assembly may be engaged with a clamp. The spindle 40 may have a slot perpendicular to both the through hole 52 and the axis of spindle 40 for linking a single bracket 156 or 280 between the spindle and the lever pins. Similarly levers 162 or 262 or mounts may be bifurcated to accommodate single bracket linkages.

It will be readily apparent to those of skill in the art that the operation of the compression spindle assembly as combined with the toggle levers described above creates a graduating pressure upon a work piece during clamping. The graduation of this pressure effected by the compression spindle assembly avoids shifting of the work piece during clamping, avoids damaging the work piece and makes the clamping movement easy to execute for a worker. Injury risk is further reduced by encapsulation of spring 30. Moreover, the interaction of the spring between the spindle and plunger, allows the plunger pressure to be applied to work pieces of varying thickness without a worker having to make an adjustment of the length of the plunger for each new differently sized work piece.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A toggle clamp comprising:

a compression spindle assembly comprising:

a plunger and a spindle, the plunger having a chamber dimensioned to slidingly receive the spindle in a telescoping arrangement, and a resilient member disposed in the plunger chamber to urge the spindle away from the plunger chamber; and a screw extending through a bore of the spindle and the plunger chamber and threaded into the plunger to maintain the spindle in sliding contact with the plunger chamber, the screw having a head abutting a shoulder monolithically formed in the spindle bore, the screw being rotatable to adjust a level of compression of the resilient member such that the compression spindle assembly reliably applies a gradual rate of pressure as the compression spindle assembly is compressed, the spindle bore being configured to allow longitudinal movement of the screw head away from the shoulder when the compression spindle assembly is compressed; and a lever linkage being operatively connected to the compression spindle assembly to move the compression spindle assembly into and out of contact with a work piece.

2. The toggle clamp of claim 1 further comprising a hole arranged in a distal end of the spindle and a linkage pin being directed through the hole to connect the compression spindle assembly to the lever linkage.

3. The toggle clamp of claim 1 wherein the screw head is accessible from a distal end of the spindle.

4. The toggle clamp of claim 1 wherein the resilient member comprises a coil spring.

5. The toggle clamp of claim 4 wherein the screw is directed through a center of the compression coil spring in the plunger chamber.

6. A toggle clamp comprising:

a compression spindle assembly comprising:

a plunger and a spindle, the plunger having a chamber dimensioned to slidingly receive the spindle in a telescoping arrangement;

a spring disposed in the plunger chamber to urge the plunger away from the spindle; and a screw extending through a bore of the spindle and the plunger chamber and threaded into the plunger, the screw having a head abutting a monolithically formed shoulder in the spindle bore and limiting movement of the spindle away from the plunger, the screw head dimensioned to slide longitudinally in the spindle bore as the spindle assembly is compressed, the screw head being rotatable to position the shoulder and adjust a length of the spring in the plunger chamber such that the compression spindle assembly reliably applies a gradual rate of pressure as the compression spindle assembly is compressed; and a lever linkage being operatively connected to the compression spindle assembly to compress the compression spindle assembly.

7. The toggle clamp of claim 6 further comprising a hole arranged in a distal end of the spindle and a linkage pin being directed through the hole to connect the compression spindle assembly to the lever linkage.

8. The toggle clamp of claim 6 wherein the screw head is accessible from a distal end of the spindle.

9. A toggle clamp comprising:

a compression spindle assembly comprising:

a Plunger with a first end adapted to engage a work piece and a second end having an opening to a chamber in an interior of the plunger;

a spindle having first end received in the plunger chamber and a second end spaced therefrom;

a spring disposed in the plunger chamber engaging the spindle first end and urging the spindle away from the plunger; and a screw directed through a bore in the spindle and the plunger chamber and threaded into the plunger first end, the screw having a head abutting the spindle second end to maintain the spindle first end in register in the plunger chamber, the screw head moving off the spindle second end as the compression spindle assembly is compressed, the screw being rotatable to adjust a level of bias of the spring such that the compression spindle assembly reliably applies a gradual rate of pressure as the compression spindle assembly is compressed; and a lever linkage being operatively connected to the spindle and adapted to move the plunger first end into and out of contact with the work piece.

10. The toggle clamp of claim 9 further comprising a hole arranged in a distal end of the spindle and a linkage pin being directed through the hole to connect the spindle to the lever linkage.

11. The toggle clamp of claim 9 wherein the spindle has an outer cylindrical shape dimensioned for sliding contact with the plunger chamber.

12. The toggle clamp of claim 9 wherein the spindle second end comprising a shoulder monolithically formed in a bore of the spindle.

13. The toggle clamp of claim 12 wherein the screw head is dimensioned to allow longitudinal sliding movement between the screw and the spindle bore as the compression spindle assembly is compressed.

14. The toggle clamp of claim 12 wherein the screw head is accessible from a distal end of the spindle.

15. The toggle clamp of claim 9 wherein the screw is rotatable to alter a length of the compression spindle assembly.

* * * * *